United States Patent [19]

Gardner et al.

[11] Patent Number: 4,934,963

[45] Date of Patent: Jun. 19, 1990

[54] ELECTRICAL CONNECTOR

[75] Inventors: Michael J. Gardner, Palatine; Lawrence E. Geib, Carol Stream, both of Ill.

[73] Assignee: Molex Incorporated, Lisle, Ill.

[21] Appl. No.: 236,428

[22] Filed: Aug. 25, 1988

[51] Int. Cl.[5] ..... H01R 13/436

[52] U.S. Cl. ..... 439/677; 439/752

[58] Field of Search ..... 439/677, 681, 733, 752, 439/869

[56] References Cited

U.S. PATENT DOCUMENTS

| | | | |
|---|---|---|---|
| 4,113,333 | 9/1978 | Horowitz | 439/752 |
| 4,284,320 | 8/1981 | Nix et al. | 439/752 |
| 4,698,030 | 10/1987 | Ryll et al. | 439/752 |
| 4,714,437 | 12/1987 | Dyki | 439/748 |

FOREIGN PATENT DOCUMENTS

| | | | |
|---|---|---|---|
| 533310 | 2/1947 | United Kingdom | 439/733 |

*Primary Examiner*—Gary F. Paumen

*Attorney, Agent, or Firm*—Louis A. Hecht

[57] ABSTRACT

An improved electrical connector includes a housing extending in an axial direction between a rear conductor entry end and a forward mating end. A plurality of terminal receiving recesses extend between the ends of the housing. A plurality of electrical terminals are slideably insertable into the recesses from the conductor entry end. A terminal lock is supported for movement on the housing between a terminal load position in which the terminal lock does not obstruct the recesses and a lock position in which the terminal lock engages terminals in the recesses. The improvement in accordance with which the terminal lock includes a forward portion disposed adjacent the forward end of the housing and permitting mating of the mating end of the housing only when the terminal lock is in the lock position.

An electrical connection assembly includes in combination first and second electrical connectors releasably mateable with one another. Each of said connectors includes a housing supporting a plurality of electrical terminals. The first connector includes a terminal lock movable relative to the housing of the first connector between a released position and a locked position in which the terminal lock engages the terminals of the first connector. The improvement in accordance with which the lock includes a portion engageable with the housing of the second connector, and the second connector housing includes a portion engaged by the portion of the lock for preventing mating of the connectors unless the lock is in the lock position.

16 Claims, 7 Drawing Sheets

ELECTRICAL CONNECTOR

FIELD OF THE INVENTION

The present invention relates to electrical connectors and more particularly to improved electrical connectors including a terminal lock moveable between a terminal load position and a terminal lock position for permitting mating only in the terminal lock position.

DESCRIPTION OF THE PRIOR ART

Electrical connectors including varius terminal retention arrangements for retaining terminals in the connector are known. Examples of electrical connectors are disclosed in U.S. Pat. Nos. 4,284,320 issued Aug. 18, 1981 to Nix et al., 4,698,030 issued Oct. 6, 1987 to Ryll et al., and 4,714,437 issued Dec. 22, 1987 to Dyki. Disadvantages of the known electrical connectors include their complexity and the resulting difficulty and time required for assembly.

SUMMARY OF THE INVENTION

It is a primary object of the present invention to provide an improved electrical connector. Other important objects are to provide an electrical connector that is simple and inexpensive to make and to assemble; to provide an electrical connector adapted to effectively retain and securely position the terminals within the connector; to provide an electrical connector including a terminal lock moveable between a terminal load position and a terminal lock position for permitting mating only in the terminal lock position; and to provide an electrical connector overcoming disadvantages of those used in the past.

In brief, the present invention provides an improved electrical connector. The electrical connector includes a housing extending in an axial direction between a rear conductor entry end and a forward mating end. A plurality of terminal receiving recesses extend between the ends of the housing. A plurality of electrical terminals are slideably insertable into the recesses from the conductor entry end. A terminal lock is supported for movement on the housing between a terminal load position in which the terminal lock does not obstruct the recesses and a lock position in which the terminal lock engages terminals in the recesses. The improvement in accordance with which the terminal lock includes a forward portion disposed adjacent the forward end of the housing and permitting mating of the mating end of the housing only when the terminal lock is in the lock position.

An electrical connection assembly includes in combination first and second electrical connectors releasably mateable with one another. Each of said connectors includes a housing supporting a plurality of electrical terminals. The first connector includes a terminal lock movable relative to the housing of the first connector between a released position and a locked position in which the terminal lock engages the terminals of the first connector. The improvement is in accordance with which the lock includes a portion engageable with the housing of the second connector, and the second connector housing includes a portion engaged by the portion of the lock for preventing mating of the connectors unless the lock is in the lock position.

BRIEF DESCRIPTION OF THE DRAWING

The present invention together with the above and other objects and advantages may best appear from the following detailed description of the embodiments of the invention shown in the accompanying drawing, wherein.

DETAILED DESCRIPTION OF THE PREFERRED EMBODIMENTS

Figure 1:
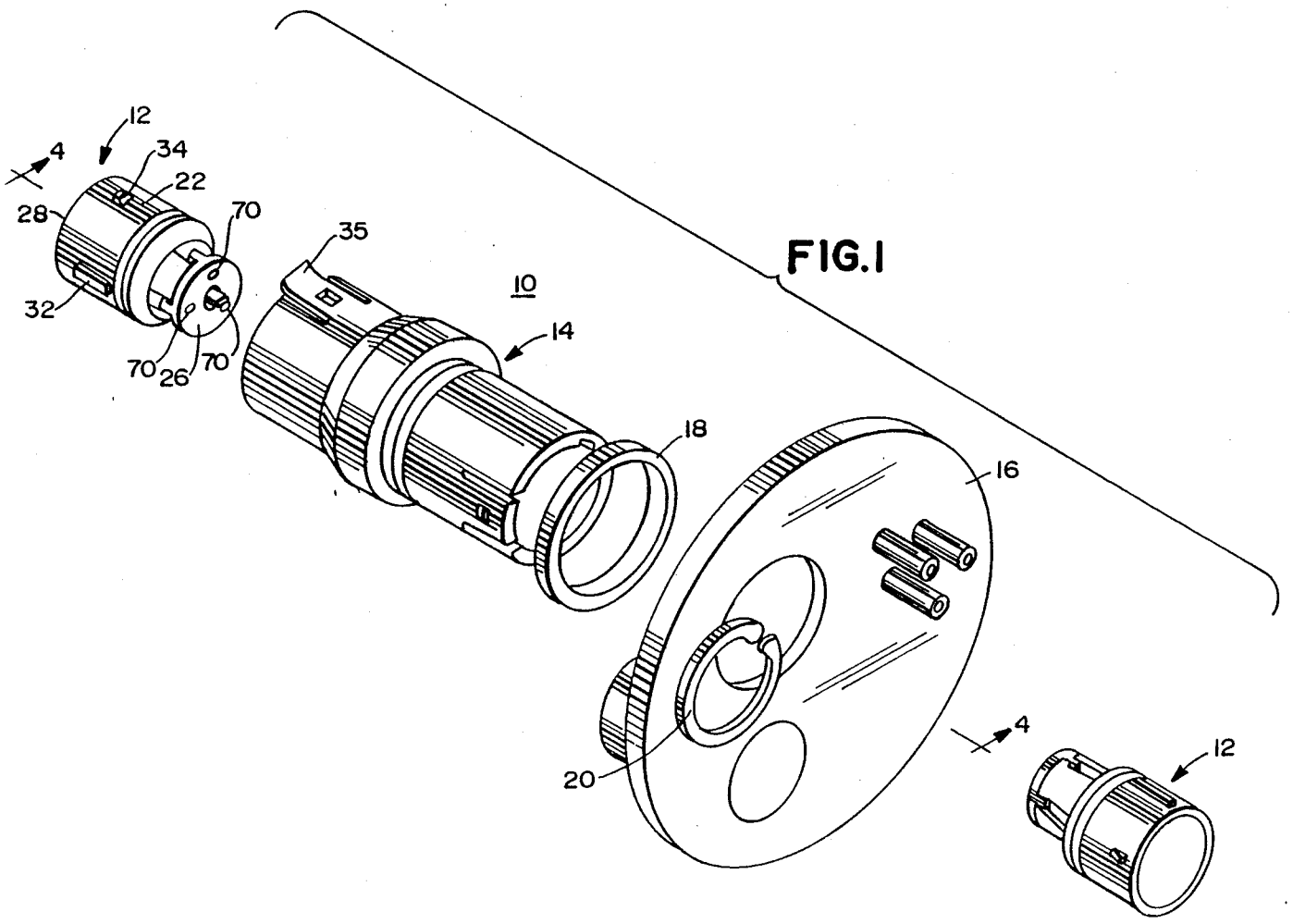
FIG. 1 is an exploded perspective view of an electrical connector assembly constructed in accordance with the present invention and illustrating the components prior to assembly.

Having reference now to FIG. 1 of the accompanying drawing, there is shown an exploded perspective view of an electrical connection assembly designated as a whole by the reference character 10 and constructed in accordance with principles of the present invention. Electrical connection assembly 10 includes an electrical connector 12 illustrated in exploded perspective view in FIG. 2 and a mating second electrical connector 14. A flange 16, a flange seal 18 and a retaining ring 20 and a second identical connector 12 are illustrated with the electrical connector assembly 10 for a particular application, although it should be understood that the electrical connector assembly 10 can be used for various different applications.

Figure 2:
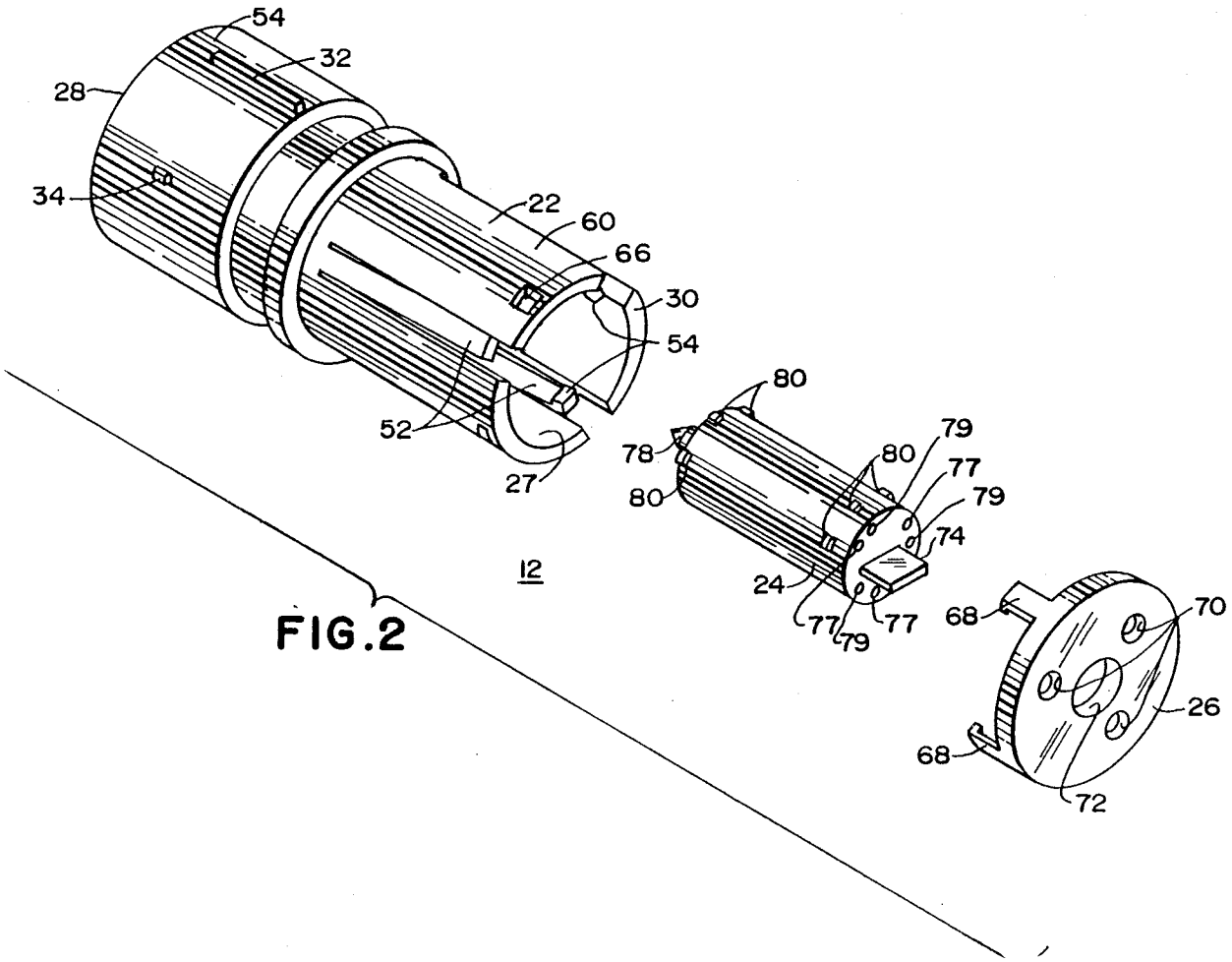
FIG. 2 is an exploded perspective view of a first electrical connector of the electrical connector assembly of FIG. 1.
Figure 4:
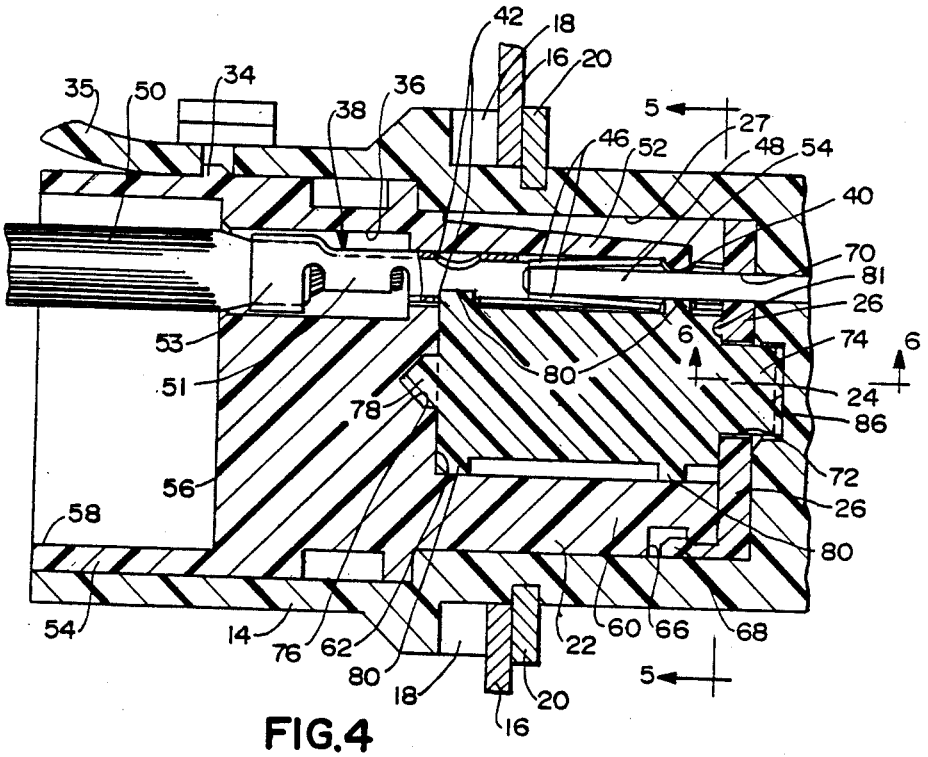
FIG. 4 is a sectional view of the first electrical connector taken along line 4—4 of FIG. 1 after the insertion of the terminals with terminated conductors and mating with a second electrical connector of the electrical connector assembly of FIG. 1.

Referring to FIG. 2, the first electrical connector 12 includes a housing 22, a terminal lock member 24 and a cap or cover 26. The terminal lock member 24 is captured within a recess 27 in the housing 22 by the cover 26 and is supported for rotational movement in the housing 22 between a terminal load position shown in FIG. 5 and a terminal lock position shown in FIG. 4. In accordance with features of the invention, mating engagement of the connectors 12 and 14 is prevented unless the terminal lock member 24 is correctly positioned in the terminal lock position as shown in FIG. 4.

The housing 22 extends in an axial direction between a rear conductor entry end 28 and a forward mating end 30. Preferably, the electrical connector housing 22 is an integral, one-piece member formed of a strong, flexible electrically insulating material. A plastic or similar material forms the housing 22 by conventional injection molding technique.

For accurate keying alignment with the mating connector 14, housing 22 includes a pair of rails 32 and a pair of latch protuberances 34. Rails 32 are received in corresponding grooves of the mating connector 14 and latch protuberances 34 are received by latch arms 35 of connector 14.

Figure 5:
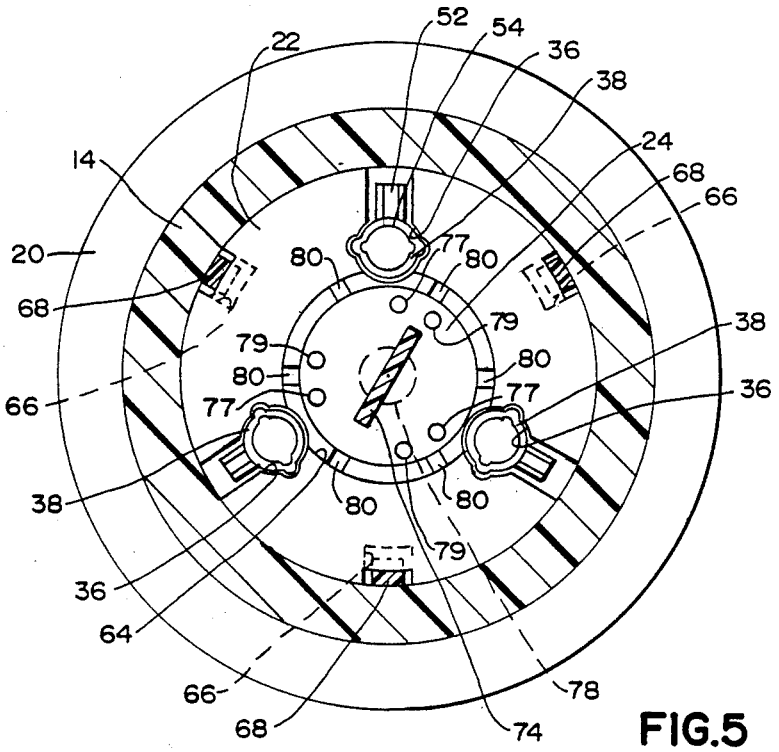
FIG. 5 is a sectional view taken along the line 5—5 of FIG. 4.

Referring also to FIG. 5, a plurality of terminal receiving recesses 36 extend between the opposite ends 28 and 30 of the housing 22. The terminal receiving recesses 36 are arrayed at approximately 120 degree intervals around and are spaced from the central longitudinal axis of housing 22. A plurality of terminals 38 are slideably inserted into the terminal receiving recesses 36 past the terminal lock member 24 positioned in the terminal load position as shown in FIG. 5.

Figure 3:
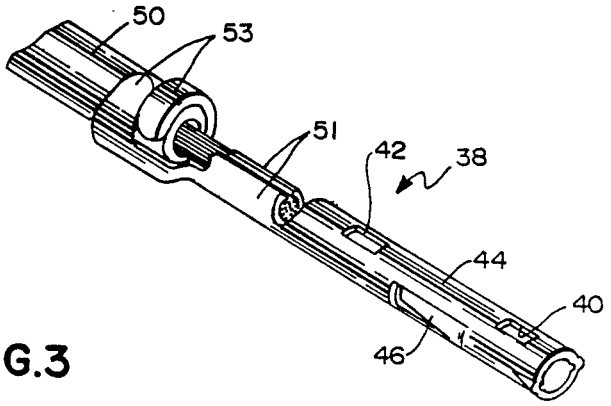
FIG. 3 is a perspective view of an electrical terminal terminated with a conductor of the electrical connector of FIG. 1.

Crimp terminals such as illustrated in FIG. 3 can be used for terminals 38, although various different terminal types can be employed. Terminals 38 include a first pair of opposed terminal locking windows 40 and an axially spaced apart second pair of opposed terminal locking windows 42 formed in a cylindrical pin-receiving terminal portion 44. A pair of opposed, resilient contact beams 46 are formed in the terminal portion 44 for the effective electrical connection with a mating pin 48 of the mating second connector 14 as shown in FIG. 4. An associated conductor 50 is terminated by each of the terminals 38 prior to insertion into the electrical connector 12 by crimping wings 51 and strain relief wings 53.

Housing 22 includes a plurality of spaced-apart resilient retaining arms 52 inwardly extending within the terminal receiving recesses 36. Each retaining arm 52 has a free end locking finger 54 for movement within one of the opposed terminal locking windows 40 as shown in FIG. 4 for orienting, positioning and retaining the terminals 38 within the housing recesses 36.

A rearward sleeve portion 54 of the housing 22 extends axially outwardly from a recessed terminal entry wall 56 defining a cavity 58 for receiving a conductor entry seal (not shown).

A forward sleeve portion 60 of the housing 22 extends axially outwardly from a recessed forward housing wall 62 defining the cavity 27 for receiving the terminal lock member 24. Sleeve 60 includes a plurality of spaced apart apertures 66 for receiving a plurality of corresponding fastening tabs 68 of the connector cover 26. The cooperating fastening structures 66 and 68 are arrayed at approximately 120 degree intervals each spaced approximately 60 degrees from the terminal receiving recesses 36. A plurality of spaced apart apertures 70 extend through the cover 26 for receiving the pin terminals 48 of the mating second connector 14. A generally centrally located aperture 72 in the cover 26 receives an axially outwardly extending positioning, camming blade 74 of the terminal lock member 24.

A recessed bearing surface 76 in the housing wall 62 provides low friction engagement with a tapered proximal end portion 78 of the terminal lock 24. A plurality of axially aligned pairs of terminal locking projections 80 extend radially at spaced locations along the terminal lock 24 for locking engagement with each of the terminals 38 in the terminal lock position. The terminal locking projections 80 are arrayed at approximately 60 degree intervals around the perimeter of the terminal lock member 24 spaced from the central longitudinal axis of housing 22. In the terminal load position shown in FIG. 5, the terminal locking projections 80 are spaced from the terminal receiving recesses 36 to permit the unobstructed sliding insertion of terminals 38 within the connector 12. The terminal locking projections 80 are received within terminal locking windows 40 and 42 for retaining the terminals 38 when the terminal lock member 24 is moved to the terminal lock position of FIG. 4.

Referring to FIGS. 2 and 4, the terminal lock member 24 includes a plurality of spaced apart pairs of recesses 77 and 79. A plurality of spaced apart protuberances 81 formed on the connector cover 26 are alternately received within the apertures 77 and 79 for positioning the terminal lock member 24 with respect to the housing 22 in the terminal load position as shown in FIG. 5.

Figure 6:
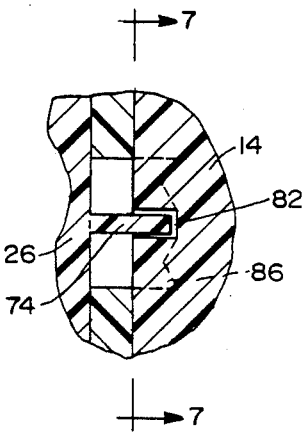
FIG. 6 is a fragmentary sectional view taken along the line 6—6 of FIG. 4.
Figure 7:
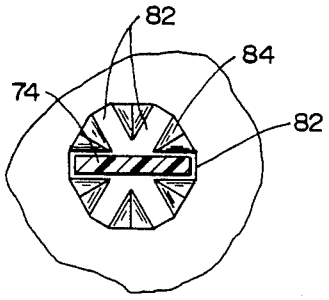
FIG. 7 is a sectional view taken along the line 7—7 of FIG. 6.
Figure 8:
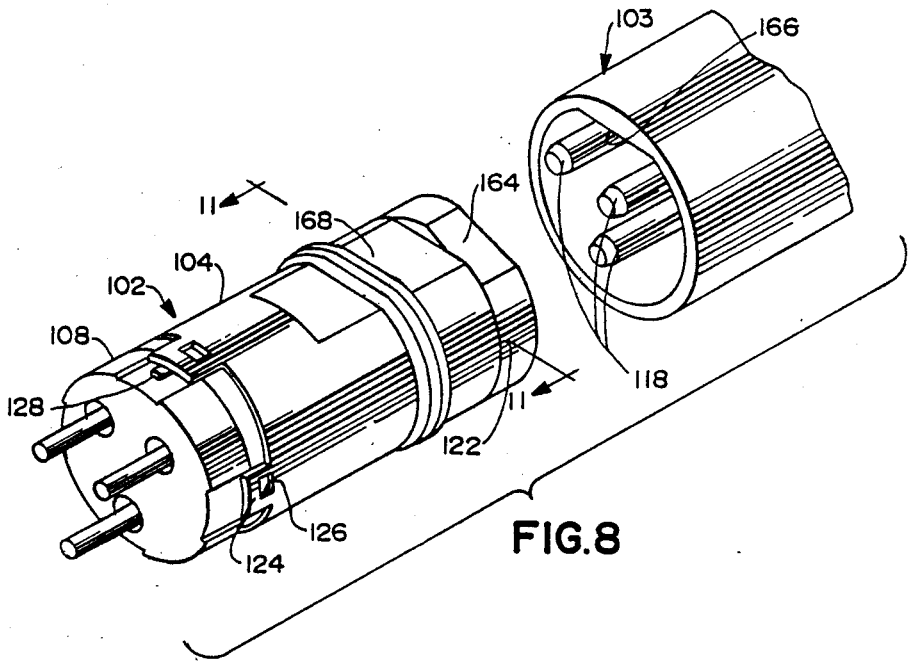
FIG. 8 is a perspective view of an alternative electrical connector assembly constructed in accordance with the present invention together with a mating electrical connector.

A plurality of keyways 82 with opposed camming surface portions or lead-in chamfers 84 are formed within a recessed housing portion 86 of the mating connector 14 as illustrated in FIGS. 6 and 7. Lock camming blade 74 is received in camming engagement with diametrically opposed ones of the camming surface portions or lead-in chamfers 84 for cam guided insertion of the blade 74 within one of the keyways 82 causing rotation of the terminal lock member 24 to the lock position.

With the terminals 38 fully inserted within the housing recesses 36, the terminal lock 24 is moved into locking position by the cooperating cam actuating structure 74 and 84 of the connectors 12 and 14. Otherwise, if the terminals 38 are not properly positioned so that the terminal locking windows 40 and 42 are not aligned for receiving the locking projections 80, the terminal lock 24 is not moved to the lock position and mating insertion of the mating pins 48 with the terminals 38 is prevented.

Referring now to FIGS. 8–13, there is illustrated an alternative electrical connector assembly designated as a whole by the reference character 100 and constructed in accordance with the present invention. Connector assembly 100 includes a first electrical connector 102 shown in exploded perspective view in FIG. 9 and a mating second electrical connector 103.

Figure 9:
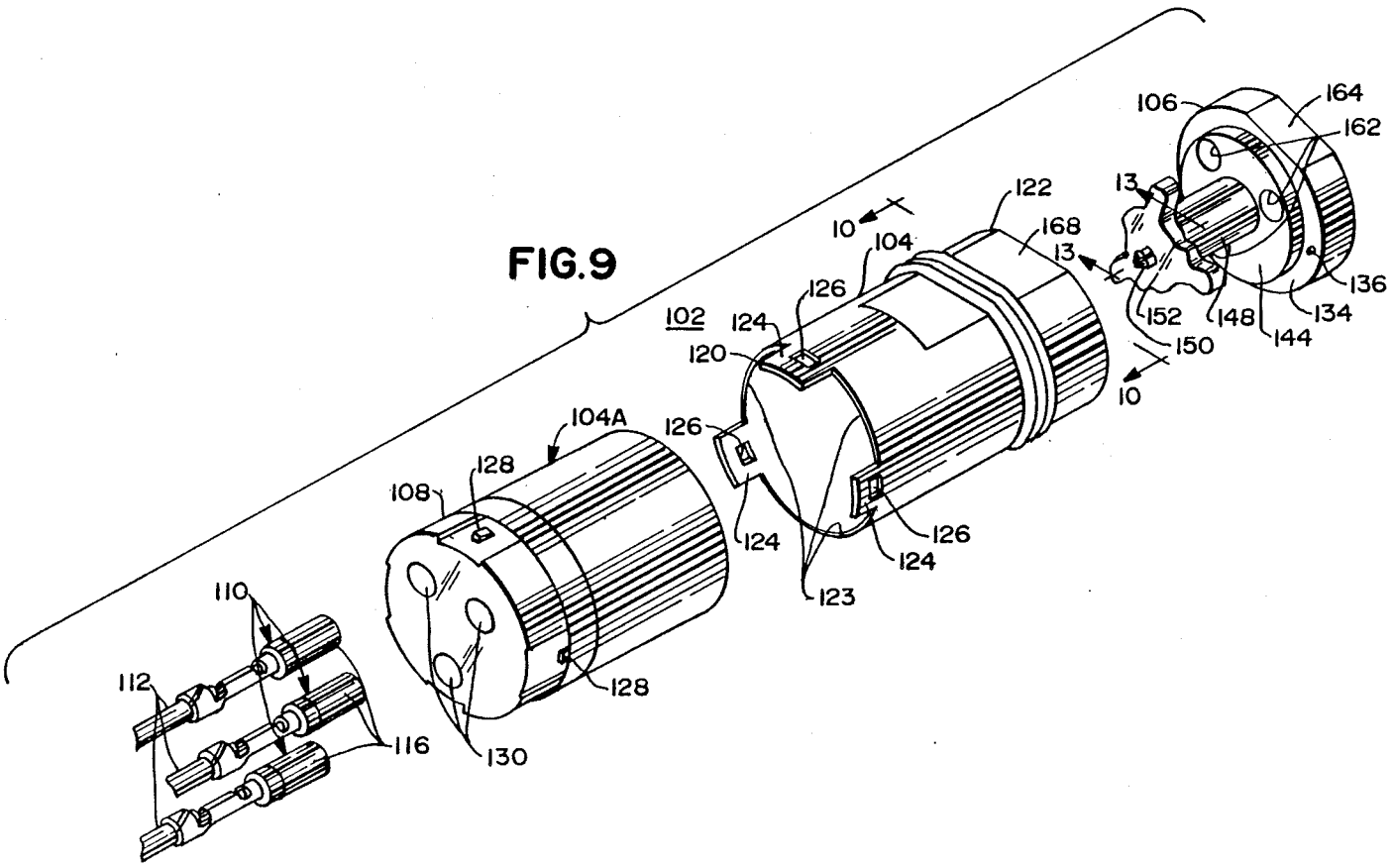
FIG. 9 is an exploded perspective view of a first electrical connector the alternative electrical connector assembly of FIG. 8 and illustrating the components prior to assembly.
Figure 11:
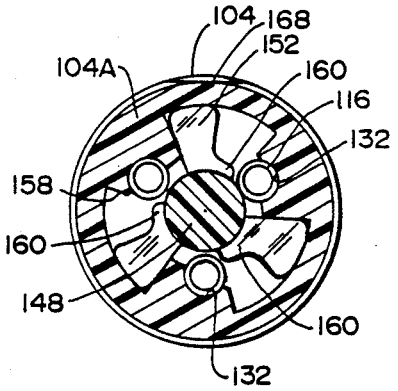
FIGS. 11 and 12 are sectional views taken along the line 11—11 of FIG. 8 illustrating a terminal lock in a terminal load position and in a lock position, respectively.
Figure 12:
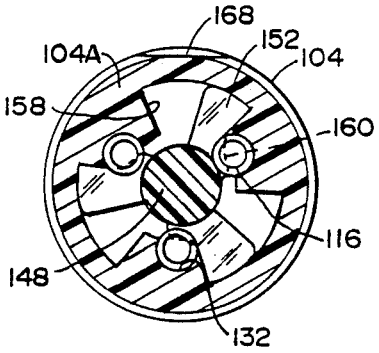

Referring to FIG. 9, the first electrical connector 102 includes a housing 104, a housing body member 104A and a terminal lock member 106. Housing 104 and the housing body member 104A alternatively can be formed as an integral, one-piece member by conventional injection molding technique. The terminal lock member 106 is supported for rotational movement on the housing 104A between a terminal load position shown in FIGS. 8 and 11 and a terminal lock position shown in FIG. 12. First electrical connector 102 includes a wire seal and strain relief member 108 and a plurality of terminals 110 each terminated with a conductor 112. Terminals 110 include a cylindrical pin-receiving terminal portion 116 for mating engagement with terminal pins 118 of the second electrical connector 103. It should be understood that various different terminal layers can be employed.

The housing 104 and housing body 104A extend in an axial direction between a rear terminal entry end 120 and a forward mating end 122. The rear terminal entry end 120 of housing 104 includes a plurality of spaced apart recessed portions 123 defining tab portions 124 having an aperture 126 between the recessed portions 123. A plurality of spaced apart protuberances 128 formed on the wire seal and strain relief member 108 are received in the apertures 126 to secure the housing body 104A with the housing shell 104. A plurality of terminal receiving apertures 130 in seal member 108 are aligned with a plurality of terminal receiving recesses 132 extending between the opposite ends 120 and 122 of the housing body 104A. The terminal receiving recesses 132 are arrayed at approximately 120 degree intervals around and are spaced from the central longitudinal axis of housing 104. The terminals 110 are slideably inserted into the terminal receiving recesses 132 with the terminal lock member 106 positioned in the terminal load position shown in FIGS. 8 and 11.

Figure 10:
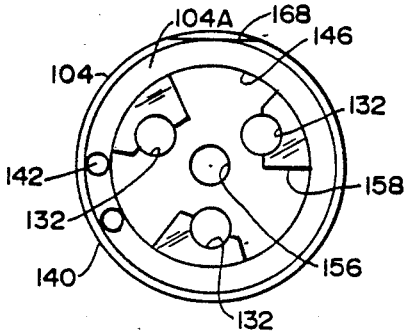
FIG. 10 is an elevational view taken along the line 10—10 of FIG. 9 illustrating a partial assembly of the first electrical connector prior to assembly of a lock member and prior to insertion of the terminals.

Terminal lock member 106 includes a cap plate 134 having an outwardly extending detent projection 136 alternately received within one of a pair of apertures 140 and 142 within the housing body 104A shown in FIG. 10 for positioning the terminal lock member 106 with respect to the housing 104 in the terminal load and lock positions. Terminal lock member 106 includes an outwardly extending plate portion 144 received within a corresponding housing aperture 146, an axially extending elongated member 148 having a tapered retainer nose portion 150 and a radially extending terminal locking member 152.

Figure 13:
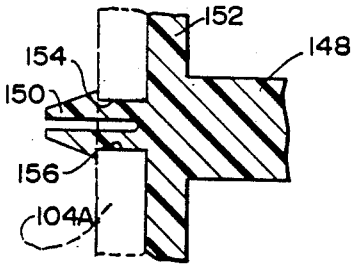
FIG. 13 is a fragmentary sectional view taken along the line 13—13 of FIG. 9.

As illustrated in FIG. 13, elongated member 148 includes a recessed base portion 154 for providing snap fit engagement of the tapered nose portion 150 within a corresponding housing body aperture 156. The radially extending terminal locking member 152 is received for rotational movement within a corresponding shaped housing body passageway 158 best shown in FIGS. 11 and 12. Terminal locking member 152 includes a plurality of terminal engaging portions 160 for retaining the terminals 110 within the housing body 104A. In the terminal load position shown in FIG. 11 the terminal engaging portions 60 are spaced apart from the terminal receiving recesses 132 to permit the unobstructed sliding insertion of the terminals 110.

A plurality of apertures 162 in the terminal lock cap plate 134 are aligned for receiving the mating terminal pins 118 of the mating second connector 103 with the terminal lock member 106 moved to the terminal lock position. A flat wall portion 164 of the terminal lock cap plate 134 corresponds to a similar flat wall portion 166 of the mating connector 103. Housing 104 includes a flat wall portion 168 adapted to be received in keying alignment with the corresponding flat wall portion 166 of the mating connector 103 after the terminal lock member 106 is moved to the terminal lock position. If the terminal lock member 106 is not in the terminal lock position mating of the connectors 102 and 103 is prevented.

Although each of the electrical connectors 12, 14, 102 and 103 is illustrated with three terminals, it should be understood that electrical connectors having various number of terminals can be constructed in accordance with the principles of the present invention.

While the present invention has been described with reference to details of the embodiments shown in the drawings, such details are not intended to limit the scope of the invention as defined in the appended claims.

We claim:

1. An electrical connector comprising:

a housing extending in an axial direction between a rear conductor entry end and a forward mating end;

a plurality of terminal receiving recesses extending between the ends of said housing;

a plurality of electrical terminals slideably insertable into said recesses from said conductor entry end;

a terminal lock supported for movement on said housing between a terminal load position in which said terminal lock does not obstruct said recesses and a lock position in which said terminal lock engages said terminals in said recesses; and the improvement in accordance with which said terminal lock includes a forward portion disposed adjacent said forward end of said housing and being configured to engage a complementary connector to permit mating of said mating end of said housing with said complementary connector only when said terminal lock is in said lock position.

2. The electrical connector of claim 1 wherein said terminal lock is mounted for rotation around the axis of said housing.

3. The electrical connector of claim 2 wherein said terminal lock includes radially extending projections engageable with said terminals in said recesses.

4. The electrical connector of claim 3, said housing and said terminals including resilient primary locking means for releasably detaining said terminals in predetermined positions in said recesses.

5. The electrical connector of claim 4, said terminal lock including a pair of said projections engageable with each said terminal at axial spaced locations along the length of said terminal.

6. The electrical connector of claim 1, said forward portion of said terminal lock including a cam actuating structure for rotating said terminal lock from the terminal load position to the lock position.

7. The electrical connector of claim 1, said forward portion of said terminal lock including a polarization structure for permitting mating of the electrical connector in said lock position of said terminal lock.

8. The electrical connector of claim 1, said housing including a body and a cap attached to said body at the forward end of said housing, said terminal lock being captured between said body and cap, and said forward portion of said terminal lock extending through said cap.

9. The electrical connector of claim 1, said housing and said terminal lock having cooperating snap fastening structures for attaching said terminal lock to said housing.

10. An electrical connection assembly comprising in combination:

first and second electrical connectors releasably mateable with one another;

each of said connectors including a housing supporting a plurality of electrical terminals;

said first connector including a terminal lock movable relative to said housing of said first connector between a released position and a locked position in which said terminal lock engages said terminals of said first connector;

and the improvement in accordance with which said lock includes a portion engageable with said housing of said second connector during mating between said first and second connectors, and said second connector housing includes a receiving portion engaged by said lock portion, said receiving portion and said lock portion preventing mating of said connectors unless said lock is in said lock position.

11. An electrical connection assembly as claimed in claim 10, said lock portion and said receiving portion comprising cam means for moving said terminal lock to said lock position before mating of said connectors.

12. An electrical connection assembly as claimed in claim 10, said lock portion and said receiving portion comprising polarizing means for permitting said connectors to mate in only a single orientation of said connectors relative to one another.

13. An electrical connection assembly as claimed in claim 10, said terminal lock being rotatable with respect to said first connector housing.

14. An electrical connection assembly as claimed in claim 13, said lock portion being located at the axis of rotation of said terminal lock.

15. An electrical connection assembly as claimed in claim 14, said terminal lock including radial projections engageable with said terminals of said first connector in the lock position of said terminal lock.

16. An electrical connection assembly as claimed in claim 15 wherein two said radial projections are engageable with each of said terminals of said first connector.

* * * * *